US005190791A

United States Patent [19]

Günter et al.

[11] Patent Number: 5,190,791

[45] Date of Patent: Mar. 2, 1993

[54] INFRARED RADIATION PROCESS FOR A HIGH CONTRAST IN THE NATURAL GRAIN OF A NATURALLY PALE WOOD

[75] Inventors: Jürgen Günter, Sindelfingen; Siegfried Köhler, Ostfildern; Siegfried Lang, Gärtringen-Rohrau; Luise Schellhorn, Sindelfingen; Erwin Lutz, Schönaich, all of Fed. Rep. of Germany

[73] Assignee: Mercedes-Benz AG, Fed. Rep. of Germany

[21] Appl. No.: 779,253

[22] Filed: Oct. 18, 1991

[30] Foreign Application Priority Data

Oct. 19, 1990 [DE] Fed. Rep. of Germany ..... 4033255

[51] Int. Cl.[5] ..... B05D 3/06; B05D 3/02

[52] U.S. Cl. ..... 427/554; 427/317; 427/557; 427/596

[58] Field of Search ..... 427/55, 56.1, 53.1, 427/317, 408

[56] References Cited

U.S. PATENT DOCUMENTS

| | | | |
|---|---|---|---|
| 317,730 | 5/1885 | Collings et al. | 427/55 |
| 2,375,113 | 5/1945 | Klammt et al. | 427/55 |
| 2,867,543 | 1/1959 | Braun | 427/317 |
| 4,044,172 | 8/1977 | Bugg | 427/55 |
| 4,170,668 | 10/1979 | Lee et al. | 427/55 |

FOREIGN PATENT DOCUMENTS

| | | |
|---|---|---|
| 0157530 | 10/1985 | European Pat. Off. . |
| 2527564 | 6/1975 | Fed. Rep. of Germany . |
| 2189367 | 10/1987 | United Kingdom . |

OTHER PUBLICATIONS

Patent Abstracts of Japan, 2 pages, Jul. 11, 1979, M Section, JP-A-54-56576 pub Jul. 5, 1979, abstract of, by Machitori.

*Primary Examiner*—Marianne Padgett

*Attorney, Agent, or Firm*—Evenson, Wands, Edwards, Lenahan & McKeown

[57] ABSTRACT

A process brings out a high contrast in natural grain of a naturally pale wood via infrared irradiation having a wavelength which is as long as possible. This infrared radiation can come from a conventional infrared emitter or, more preferably, from a carbon dioxide laser. Due to the contact-free heating near the surface which is effective in a stagnant ambient atmosphere, the new wood part of the grain is browned, while the harder old wood part remains essentially unbrowned. This causes the natural grain of the wood to stand out in contrast. Due to the contact-free and turbulence-free mode of operation of the heating, the grain pattern produced is uniform. Any scratches or chatter marks in the wood are simply covered over and remain invisible.

23 Claims, 1 Drawing Sheet

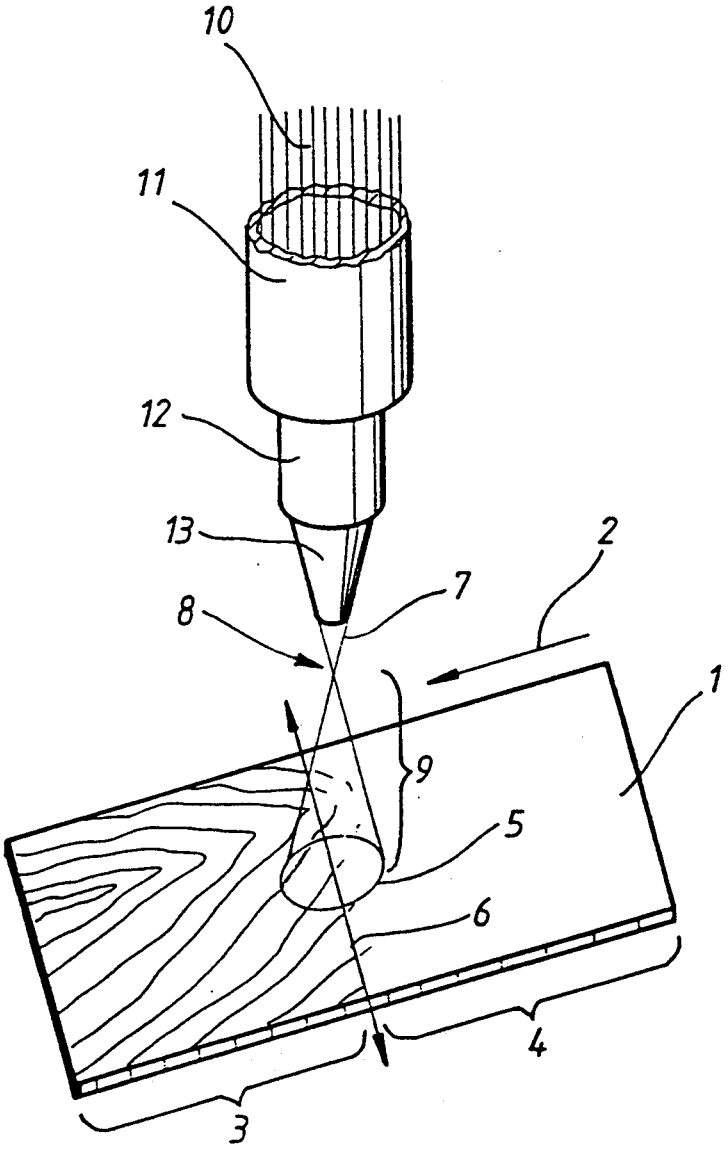
10
11
12
13
2
7
8
1
9
5
6
4
3

INFRARED RADIATION PROCESS FOR A HIGH CONTRAST IN THE NATURAL GRAIN OF A NATURALLY PALE WOOD

BACKGROUND AND SUMMARY OF THE INVENTION

The present invention relates to a process for bringing out a high contrast in the new wood part near the surface relative to the old wood part in the grain pattern of a piece of wood which has little contrast in the original state, preferably an almost uniformly light piece of wood, as previously known, for example, by the so-called flaming of wood in wood technology.

The conventional processes of wood flaming take place, however, in two stages. The wood is first charred near the surface, and the carbonized layer is then being brushed off again. In the course of brushing the softer new wood part is removed to a greater extent and becomes light in appearance again, while the harder old wood part is removed to a lesser extent and consequently stands out not only in relief, but also contrasting highly in color relative to the new wood part. This type of wood treatment is suitable for a rustic appearance of wood items, where very strong color contrasts and also a very strong surface shaping of the grain pattern are important. In the case of items where a smooth surface is desired this browning technique is not possible.

It is also conceivable for the flaming to be carried out with a relatively low heat intensity, so that browning is limited to the soft new wood parts, while the harder old wood parts still remain pale. The disadvantage of this process is, however, that the browning pattern becomes very uneven on account of an uneven convection which is associated with the flame formation and which, in some circumstances, can be increased even further by a veneer sheet treated in this way becoming wavy.

Contact browning processes for bringing out a highly contrasting wood grain in naturally pale wood items are also known. Hot-stamping is, however, generally used in these cases. A new, stereotyped grain pattern is hot-stamped in this way into a uniformly light wood with little surface structure, in the course of which not only a surface structuring but a differing heat supply and also browning, to a greater or lesser extent, are achieved through a selected unevenness in the temperature distribution and/or the surface pressing during the stamping operation. The disadvantage here is that only a stereotyped grain pattern corresponding to the stamping die can be achieved, but further that the natural grain of the wood itself cannot be brought out by the process.

Another known contact browning process operates with heated rollers between which the veneer sheet is passed. In the course of this passage, the softer new wood parts are browned to a greater extent than the harder old wood parts. The disadvantage of this process is that the grain pattern emerges locally in varying different degrees, which may be attributed not only to locally different thicknesses of the veneer sheet, but also to local differences in moisture within the veneer sheet. In addition, original slight stress marks of the wood which initially remained invisible become clear to the eye in the browned grain pattern. At best, very uniformly thick veneer sheets which have a very finely worked surface can be treated in this way. Despite everything, only a very low color contrast is achievable.

An object of the present invention is, therefore, to develop a basic process such that, despite any waviness of the veneer sheet, fluctuations in thickness, moisture fluctuations or slight chatter marks, a uniform and intensive color contrast of the natural grain, together with the smooth final surface of the piece of wood, can still be achieved in a single operation.

This object has been achieved according to the present invention by making the heat application contact-free through infrared radiation in a stagnant ambient atmosphere. Due to the contact-free infrared irradiation, uniform grain patterns can be achieved even if there are fluctuations in thickness. A turbulence or convection pattern disturbing the uniformity of the browned grain pattern is not produced by the heat radiation. On account of the careful but still intensive heat application, a high intense color contrast can also be achieved.

BRIEF DESCRIPTION OF THE DRAWING

These and other features, objects and advantages of the present invention will become more readily apparent from the following detailed description of a currently preferred embodiment when taken in conjunction with the single FIGURE which shows schematically in perspective view the application of heat to a veneer sheet by way of a laser beam.

DETAILED DESCRIPTION OF THE DRAWING

In the process shown in the drawing for carrying out the present invention, a veneer sheet 1 can be moved past a stationary laser optical system 12 in a conveyance direction indicated by the arrow 2. The laser optical system 12 is supplied with a monochromatic high-energy basic laser beam 10 from a carbon dioxide laser resonator, having a relatively long wavelength of 10.6 μm well into the infrared light range and thus constituting infrared light. The basic laser beam 10 travels to the laser optical system 12 in a tube 11 surrounding the beam 10. A focused laser beam 7 with a focus 8 is generated by the laser optical system 12. The focused laser beam 7 opens out again into a diverging beam 9 beyond the focus 8. A protective cone 13 for protecting the laser optical system against the ingress of dirt is also disposed connected directly to the laser optical system 12. The laser optical system 12 is disposed at such a distance from the surface of the veneer sheet 1 that the focused laser beam first strikes the veneer sheet 1 with its diverging beam part 9 with a relatively large focal spot 5. Since, however, the de-focused focal spot 5, despite its size, is smaller in diameter than the width of the veneer sheet to be treated, this focal spot 5 can be moved to and from over the veneer sheet 1 in a high-frequency pendulum movement shown by the double-headed arrow 6 directed at right angles to the conveyance direction 2, so that the thermal energy can be supplied virtually to the entire width of the veneer sheet at the level of the laser optical system 12.. In this process, the laser optical system 12 does not itself have to be pivoted, but the basic laser beam 10 is already applied in an appropriate pendulum movement, to the laser optical system 12 by a rapidly oscillating deflecting mirror, so that the focused beam emerging from the laser optical system oscillates in the desired manner even when the lens is stationary.

Due to the relatively great distance of the focal spot 5 from the laser optical system 12, relatively large oscillation amplitudes, i.e. working width, can also be achieved. In order to avoid an energy loss towards the edge, caused by distance and the oblique angle, despite the oscillation of the beam 9, it is within the contemplation of the present invention to clamp the veneer sheet cylindrically in a channel shape concentrically to the pendulum movement. Another way of ensuring a beam intensity of equal magnitude in the edge region, despite the beam oscillation, is to reduce the oscillation speed towards the edge or to raise the beam output as a function of the beam deflection, towards the edge, caused by the oscillation.

If the process parameters are synchronized correctly, as discussed in greater detail below, the natural grain of the veneer sheet can be brought out with great contrast in a single pass. The grain of the part 3 of the veneer sheet 1 which has already passed the laser optical system 12 is clearly shown in the drawing, in contrast with which the untreated part 4 of the veneer sheet 1 which has not yet passed is still pale and uniformly light. The browning is achieved in the softer new wood parts, while the harder old wood parts are not browned at all, or at best are only slightly browned. Consequently, the natural grain of the originally almost uniformly light, i.e. pale, wood stands out with high contrast, and acquires a very beautiful and attractive appearance. Because of the contact-free and turbulence-free mode of operation of the browning process according to the present invention, fluctuations in thickness or in moisture within the veneer sheet 1 cannot have any adverse effect on a uniform appearance of the grain. Any fluctuations are perceptible only to the skilled eye. Small chatter marks or other small scratches which are not noticeable in the untreated wood also remain virtually invisible after the treatment. These marks disappear entirely into the browned grain pattern which has been produced.

The treatment parameters of one treatment example performed on a laboratory scale are as follows. A veneer sheet of ash wood with the external dimensions 115×66 cm was treated. A de-focused, diverging laser beam of a carbon dioxide laser with a focal spot diameter of 11 cm was directed onto the surface. The wavelength of the monochromatic beam was 10.6 μm. The laser beam had an output of 1700 watts; it was not mode-free, but had a non-uniform energy distribution with three concentric circular maxima of its energy density over the beam cross-section. Unlike the process diagram shown in the drawing, however, in this laboratory treatment example, the laser beam was not oscillated at right angles to the direction of advance, while the veneer sheet was held stationary. Browning was carried out line by line parallel to the direction of the grain of the veneer sheet, and, with a focal spot diameter of 11 cm, a line spacing of 7 cm was selected because, despite a focal spot diameter of 11 cm, only a 7 cm-wide browned track was produced. This can be attributed essentially to the circular contour of the focal spot and to an energy density which decreased towards the edge. The speed of advance of the laser beam relative to the stationary veneer sheet was 6 m/min. Due to such pretreatment and in accordance with a red/brownish patination, a grain pattern looking amazingly similar to the tropical zebrawood could be achieved on native ash wood, so that the use of tropical wood can be dispensed with by use of the process of the present invention.

Although, in the process shown in the drawing and also in the case of the treatment example described immediately above, the radiation of a carbon dioxide laser was used, it is contemplated that similar results can also be achieved with conventional infrared emitters in a mixed mode with pre-heating, in which case it must only be ensured that the beam intensities and the application times are comparable. It goes without saying that fine-tuning of the process parameters must be carried out for each individual case, because each type of wood and possibly also each batch of wood reacts differently again. Besides, the process parameters also depend, of course, on how intensively the wood is to be browned. Such optimization of the process is best carried out with a laser unit, because in this case the output data can be varied most simply.

On the basis of the experience gained so far, it can be said that in the heat application a specific energy quantity of 15 to 60 $Ws/cm^2$, preferably about 20 to 25 $Ws/cm^2$, must be used in order to achieve intensive and highly contrasting browning of the early new part in the grain relative to the old wood part. This means that, per surface element, a certain limited amount of heat must be introduced. Attention must, however, be drawn to the fact that the heat application per surface element is limited to a relatively short time span of from half a second to about one second, i.e. this is essentially a brief heating period at relatively high energy density, so that an intensive, high-contrast and uniform browning result of a certain application depth can be achieved. With very high energy densities and brief application times, the color contrast between new wood and old wood parts could in some circumstances become less, because with very high energy densities the harder old wood part is also browned. With very low energy densities and long application times browning may hardly occur at all and that hardly any contrasts at all are accordingly achieved in the grain.

The infrared light band comprises rays with wavelengths from 0.78 to 1000 μm. An ordinary infrared emitted with a narrowband wavelength spectrum of from 1 to 2.5 μm and the laser beam of a neodymium YAG laser with monochromatic infrared light and a wavelength of 1.06 μm were tested for the browning. It was found that the longer the wavelength of the infrared light, the better are the contrasts. The best contrasts were achieved with the carbon dioxide laser, but this is relatively expensive to buy and to operate because of the poor efficiency. It therefore is within the scope of the present invention to carry out a mixed operation by preheating the wood with a conventional infrared radiator which is inexpensive to buy and maintain, and carrying out the actual contrasting operation using less laser energy with a less powerful carbon dioxide laser.

When using laser light, it is considered expedient to employ so-called beam integrators which make it possible to alter the beam cross-section to a square or rectangular shape. With such beam integrators, it is possible in some circumstances to alter the energy density of the beam in a suitable manner, for example to constant energy density in the entire beam cross-section, or to an increased energy density in the edge zone.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for bringing out a contrast in a grain pattern of a wood component having portions of different age which have insufficient original contrast relative to each other and consisting essentially of one of a solid piece of wood, a veneered component and a veneer sheet, comprising the step of applying heat to a visible face of the component near the surface thereof for a period of time sufficient only to cover the entire surface of the compound with uniform heat intensity for bringing out the contrast, in a contact-free manner, through infrared radiation in a stagnant ambient atmosphere.

2. The process according to claim 1, wherein a specific energy quantity of 15 to 60 $Ws/cm^2$ is used in the heat application step.

3. The process according to claim 1, wherein the heat application step per unit of the surface covered occurs in a time span of from half a second to two seconds.

4. The process according to claim 3, wherein a specific energy quantity of 15 to 60 $Ws/cm^2$ is used in the heat application step.

5. The process according to claim 1 wherein the heat application step is carried out at least partially by an infrared emitter.

6. The process according to claim 5, wherein a specific energy quantity of 15 to 60 $Ws/cm^2$ is used in the heat application step.

7. The process according to claim 5, wherein the heat application step per surface element is limited to a time span of from half a second to two seconds.

8. The process according to claim 1, wherein the infrared radiation contains mainly wavelengths of over 2 $\mu m$.

9. The process according to claim 8, wherein a specific energy quantity of 15 to 60 $Ws/cm^2$ is used in the heat application step.

10. The process according to claim 9, wherein the heat application step per surface element is limited to a time span of from half a second to two seconds.

11. The process according to claim 10, wherein the heat application step is carried out at least partially by an infrared emitter.

12. The process according to claim 1, wherein the heat application step is carried out by a heat source comprising a carbon dioxide laser.

13. The process according to claim 12, wherein the diverging part of a focused laser beam from the laser is applied to the surface of the component.

14. The process according to claim 13, wherein a specific energy quantity of 15 to 60 $Ws/cm^2$ is used in the heat application step.

15. The process according to claim 14, wherein the heat source includes an infrared emitter.

16. The process according to claim 1, wherein the heat application step takes place with a relative shift between the component and a heat source providing an infrared radiation beam at a constant distance there between, as measured in the direction of the beam.

17. The process according to claim 16, wherein the relative shift takes place at speed of about 3 to 10 m/min.

18. The process according to claim 1, wherein the grain contrasted through the infrared radiation is fixed by application of a clear varnish for protection from dirt or smudging during further processing.

19. The process according to claim 1, wherein the component is ash wood.

20. The process according to claim 1, wherein the component is moved in a conveyance direction relative to a source of the infrared radiation, with the source providing a focal spot which is moved at high frequency in a direction transverse to the conveyance direction.

21. The process according to claim 1, wherein a source of the infrared radiation is oscillated in an arcuate path, and the component is curved to conform to the arcuate path of the source.

22. The process according to claim 1, wherein a source of the infrared radiation provides a beam which is oscillated relative to a direction of conveyance of the component, and at least one of a speed of the oscillation and an output of the beam is varied to maintain a desired beam intensity.

23. The process according to claim 1, where a source of the infrared radiation is a laser beam which strikes the component with a diverging portion of the beam to provide a focal spot of sufficient size to treat a large area of the component.

* * * * *